US005787954A

United States Patent [19]

Herrera

[11] Patent Number: 5,787,954

[45] Date of Patent: Aug. 4, 1998

[54] SHOWER CURTAIN RING

[76] Inventor: Frederick F. Herrera, 9414 Brenham Ct., Houston, Tex. 77064-7430

[21] Appl. No.: 794,894

[22] Filed: Feb. 5, 1997

[51] Int. Cl.[6] ..... E06B 9/56

[52] U.S. Cl. ..... 160/330; 160/DIG. 6; 16/87.2

[58] Field of Search ..... 160/330, 340, 160/341, 344, DIG. 6; 4/608; 16/87 R, 87.2, 87.4 R

[56] References Cited

U.S. PATENT DOCUMENTS

| | | | |
|---|---|---|---|
| 906,132 | 12/1908 | Hansen et al. | 16/87.2 |
| 1,130,362 | 3/1915 | Wogan | 16/87.2 |
| 1,519,106 | 12/1924 | Beck | 16/87.2 |
| 2,320,308 | 5/1943 | Silverman | 160/341 |
| 2,711,555 | 6/1955 | Hanson | 16/87.2 |
| 3,115,181 | 12/1963 | Snyder | 160/330 X |
| 3,737,943 | 6/1973 | Store | 16/87.2 |
| 3,772,734 | 11/1973 | Kimel | 16/87.2 |
| 4,010,503 | 3/1977 | Denton | 16/87.2 |
| 5,339,884 | 8/1994 | Angerman | 160/330 |
| 5,355,551 | 10/1994 | Schechter et al. | 16/87.2 |
| 5,367,742 | 11/1994 | Bindman | 16/87.2 |
| 5,497,537 | 3/1996 | Robinson et al. | 160/330 X |
| 5,586,375 | 12/1996 | Cooperman et al. | 160/330 X |

*Primary Examiner*—David M. Purol
*Attorney, Agent, or Firm*—Arnold, White & Durkee

[57] ABSTRACT

A shower curtain assembly is disclosed that comprises a substantially horizontal shower curtain rod, a shower curtain having an upper edge, and a plurality of shower curtain rings. Each ring includes (1) a body member that encircles the shower curtain rod, the body member having first and second ends, (2) a first end locking member which is attached to the first end of the body member and includes a male locking protrusion, and (3) a second end locking member which is attached to the second end of the body member and includes a female locking receptacle, the female locking receptacle being adapted to receive and hold the male locking protrusion. The upper edge of the shower curtain is held between the male locking protrusion and the female locking receptacle of each shower curtain ring, whereby the curtain is deformed and held between the male locking protrusion and the female locking receptacle without any part of the shower curtain ring passing through the shower curtain. This arrangement decreases the chance that the curtain will be torn by the rings, as compared to prior shower curtain assemblies.

14 Claims, 2 Drawing Sheets

SHOWER CURTAIN RING

BACKGROUND OF THE INVENTION

The present invention relates to an improved device for suspending a shower curtain. More particularly, the present invention concerns an improved ring device for suspending a shower curtain from a horizontal rod.

It is well known to use a flexible shower curtain on one side of a shower enclosure. The shower curtain can be pulled back to allow a person to enter the shower, and can be extended to its full length when the shower is being used, in order to prevent water from spraying or splashing out of the shower enclosure. The shower curtain is typically suspended from a horizontal shower curtain rod. Several rings are typically placed over the rod, so they are supported by the rod but can slide horizontally in either direction along the length of the rod. The rings typically pass through eyelets in the top edge of the shower curtain, in order to suspend the curtain above the ground.

A variety of shower curtain rings have been described in the prior art. For example, Angerman U.S. Pat. No. 5,339,884 discloses a shower curtain ring that has frictionally inter-engaging end members. One of the end members includes an elongated part which is received through an opening along the top edge of the shower curtain. Zinger U.S. Pat. No. 5,513,419 describes a shower curtain rod assembly which includes shower curtain clips. The shower curtain clips include a ring-type clamp. The ring can be pulled apart to allow the ring to pass through an eyelet in the curtain. At column 4, lines 31–33, Zinger says that another embodiment of the clip is a clamp which grips the shower curtain in a clamping or pinching manner.

One problem with shower curtain rings is their tendency to tear the shower curtain. Although the eyelets in the top edge of the shower curtain are typically reinforced, after the curtain has been opened and closed a number of times, the rings tend to tear through the edge of the eyelets. This is especially true if a person using the shower grabs the curtain and pulls down on it, either intentionally or by accident. The tears that result sometimes extend entirely thorough the edge of the curtain, making that torn eyelet unable to serve as a point of support for the curtain. Such tears are visually unattractive. Further, if several eyelets adjacent to each other suffer complete tears, the shower curtain can sag substantially in that area. If all of the eyelets suffer complete tears, then the shower curtain will fall to the floor.

There is a long-standing need for improved devices for supporting shower curtains, that will have less tendency to tear the shower curtain.

SUMMARY OF THE INVENTION

The present invention concerns a shower curtain assembly that comprises a substantially horizontal shower curtain rod, a shower curtain having an upper edge, and a plurality of shower curtain rings. "Substantially horizontal" means that the rod is very close to being exactly horizontal (i.e., tilted no more than about 5°). Each of the rings includes (1) a body member that encircles the shower curtain rod, the body member having first and second ends, (2) a first end locking member which is attached to the first end of the body member and includes a male locking protrusion, and (3) a second end locking member which is attached to the second end of the body member and includes a female locking receptacle, the female locking receptacle being adapted to receive and hold the male locking protrusion. The rings are preferably circular in configuration, but can take other forms, and the use of the word "encircle" should not be taken to imply otherwise. The upper edge of the shower curtain is held between the male locking protrusion and the female locking receptacle of each shower curtain ring. As a result, the curtain is deformed and held between the male locking protrusion and the female locking receptacle without any part of the shower curtain ring passing through the shower curtain.

In certain preferred embodiments, the male locking protrusion comprises a central body portion and a horizontal bar having an enlarged outer tip, the horizontal bar being attached to the central body portion. The male locking protrusion also preferably comprises a first closure pressure surface that is attached to the horizontal bar and a first opening pressure surface that is also attached to the horizontal bar. Both of these pressure surfaces are preferably vertical.

In certain preferred embodiments, the female locking receptacle comprises a horizontal channel which faces toward the male locking protrusion and has a longitudinal aperture. This horizontal channel preferably has a vertical inner diameter that is greater than the vertical size of the longitudinal aperture. The female locking receptacle also preferably comprises a second closure pressure surface and a second opening pressure surface. Both of these pressure surfaces are preferably vertical.

Another embodiment of the present invention is a shower curtain ring that includes (1) a body member that is adapted to encircle a shower curtain rod, the body member having first and second ends; (2) a male locking protrusion which is attached to the first end of the body member and comprises (a) a central body portion, (b) a horizontal bar having an enlarged outer tip, the horizontal bar being attached to the central body portion, (c) a first closure pressure surface, and (d) a first opening pressure surface, (3) a female locking receptacle which is attached to the second end of the body member and is adapted to receive and hold the male locking protrusion, the female locking receptacle comprising (a) a horizontal channel which faces toward the male locking protrusion and has a longitudinal aperture, the horizontal channel having a vertical inner diameter that is greater than the vertical size of the longitudinal aperture, (b) a second closure pressure surface, and (c) a second opening pressure surface. The male locking protrusion and female locking receptacle are adapted to hold the upper edge of a shower curtain being such that the curtain is deformed and held between the male locking protrusion and the female locking receptacle without any part of the shower curtain ring passing through the shower curtain.

The present invention provides an effective means for holding a shower curtain while reducing the tendency for the curtain to tear at or near the points where it is held by the rings.

DESCRIPTION OF SPECIFIC EMBODIMENTS

Figure 1:
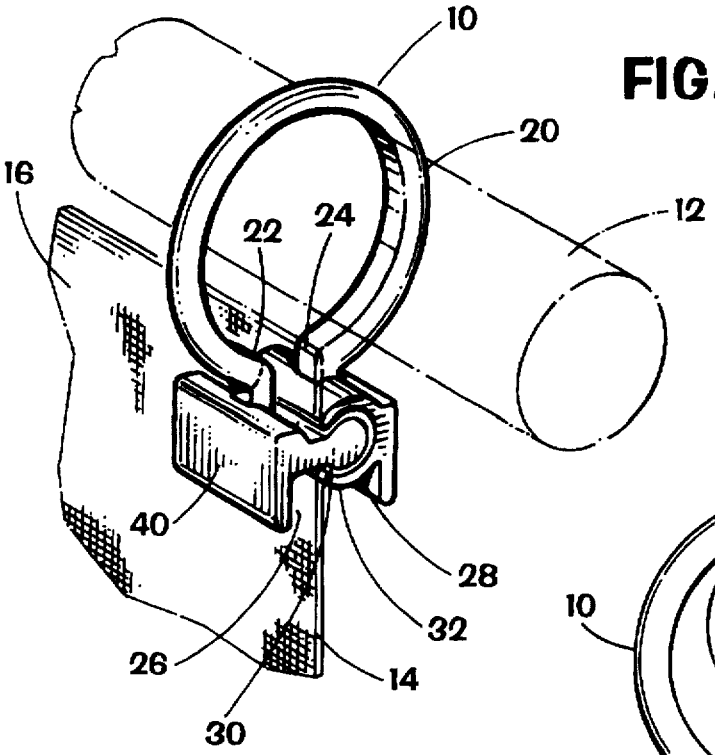
FIG. 1 is a perspective view of a shower curtain ring in accordance with the present invention hanging on a rod and holding a shower curtain.

One embodiment of the present invention is shown in FIG. 1. Various parts may be seen more clearly in FIGS. 2–4.

A shower curtain ring 10 is mounted on a shower curtain rod 12, and a plurality of the rings (only one of which is shown in the figures) hold a shower curtain 14 by gripping the curtain at or near its top edge 16. The ring 10 encircles the rod 12, thus holding the curtain at the desired height above the floor, while also permitting the rings and curtain to slide along the length of the rod. Although the rings 10 are preferably circular, they do not have to take that form. Other configurations, such as oval or triangular rings, could also be used.

Figure 2:
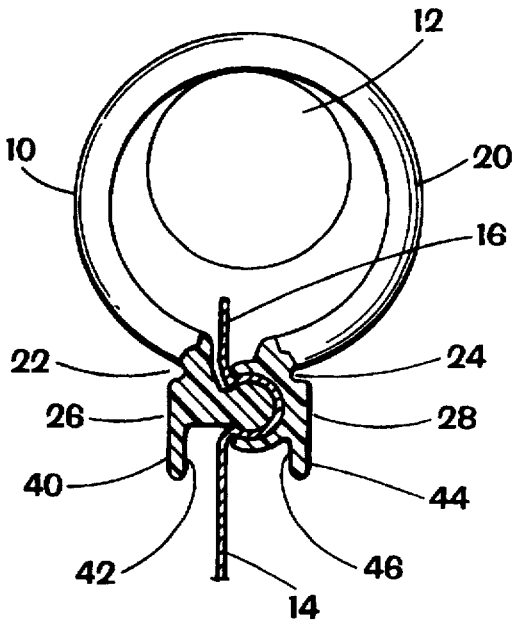
FIG. 2 is a side cross-sectional view of the ring, rod, and curtain of FIG. 1, viewed from one end of the rod.
Figure 3:
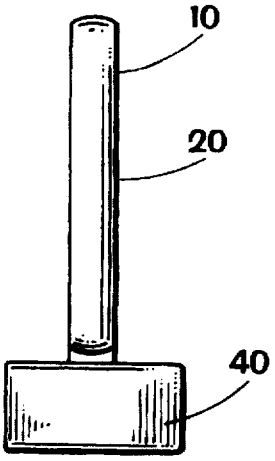
FIG. 3 is another side view of the ring, from a view perpendicular to the view in FIG. 2.

The ring 10 includes a body member 20, which preferably takes the form of an elongated rod that is curved to form a generally circular ring. The body member 20 has a first end 22 and a second end 24, which can be seen in FIG. 2. Attached to the first end 22 is a first end locking member 26 and attached to the second end 24 is a second end locking member 28. The first end locking member 26 includes a male locking protrusion 30, and the second end locking member includes a female locking receptacle 32, which can be seen in FIG. 4, which shows the ring 10 in the open position. The female locking receptacle 32 is adapted to receive and hold the male locking protrusion 30, as shown in FIGS. 1 and 2.

In a preferred embodiment, the male locking protrusion 30 includes a central body portion 34 and a horizontal bar 36 having an enlarged outer tip 38. The male locking protrusion 30 also preferably includes a first closure pressure surface 40 and a first opening pressure surface 42, both of which are attached to the central body portion 34.

The enlarged outer tip preferably has a vertical cross-section that is primarily circular. "primarily circular" in this context means that the perimeter of the cross-section will form a circular arc for more than 180°, preferably more than about 250°.

Similarly, the female locking receptacle 32 preferably includes a second closure pressure surface 44 and a second opening pressure surface 46. The receptacle 32 also includes a horizontal channel 48 that runs parallel to the bar 12, with the channel 48 having a longitudinal aperture 50 that faces toward the enlarged tip 38 of the male locking protrusion 30. The horizontal channel 48 preferably has a vertical cross-section that is primarily circular. The enlarged tip 38 has a size that is roughly the same as the size of the opening in the channel 48. The vertical size of the aperture 50 is smaller that the vertical thickness of the tip 38.

Figure 4:
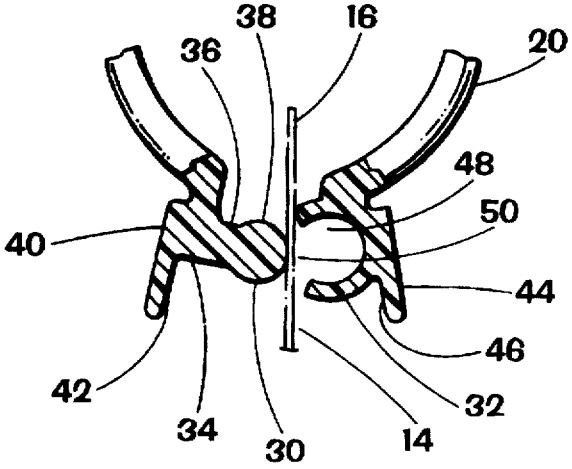
FIG. 4 is a side cross-sectional view of the ring, rod, and curtain, from the same vantage point as in FIG. 2, but with the ring opened.

A plurality of the rings are placed over the rod 12, spaced apart from each other along the length of the rod. The curtain 14, which will typically be flexible, is placed in the desired position relative to the rod 12. With the rings in the open position, the upper edge 16 of the curtain is inserted between the male locking protrusion 30 and the female locking receptacle 32, as shown in FIG. 4. A person can place on finger on the first closure pressure surface 40 and another finger on the second closure pressure surface 44. By applying pressure with those two fingers, the enlarged outer tip 38 is forced against the aperture 50. Continued pressure causes the female locking receptacle 32 to spread apart, in effect temporarily enlarging the aperture 50. This allows the tip 38 to pass into the opening in the channel 48. Once the tip 38 has so entered the channel, the aperture 50 returns to its original size. Thus the male locking protrusion 30 and female locking receptacle 32 are held together with the upper edge 16 of the curtain 14 held between them. In this way, the curtain is held in the desired position, but no part of the ring mechanism penetrates the curtain. Because the curtain remains a continuous sheet, with no holes formed in it, it is less likely to tear than prior shower curtains.

When the curtain needs to be removed, a person can place one finger on the first opening pressure surface 42 and another finger on the second opening pressure surface 46. Applying pressure with those two fingers will force the enlarged tip 38 out of the female locking receptacle 32, temporarily enlarging the aperture 50 in the process, and will release the curtain 14. Thus the engagement between the male locking protrusion 30 and the female locking receptacle 32 is easily releasable by manual pressure.

Figure 5:
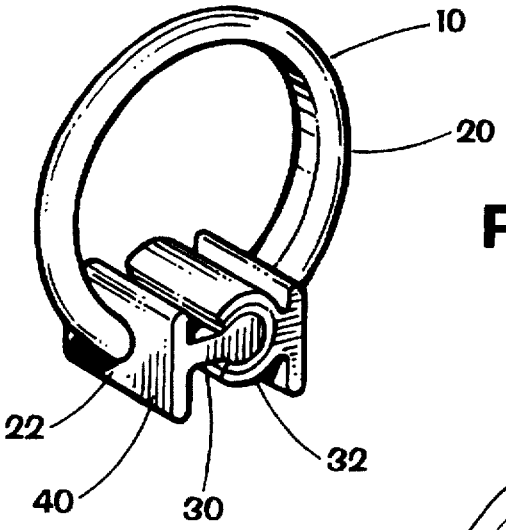
FIG. 5 is a perspective view of another embodiment of the ring in the closed position, without the rod or curtain.
Figure 6:
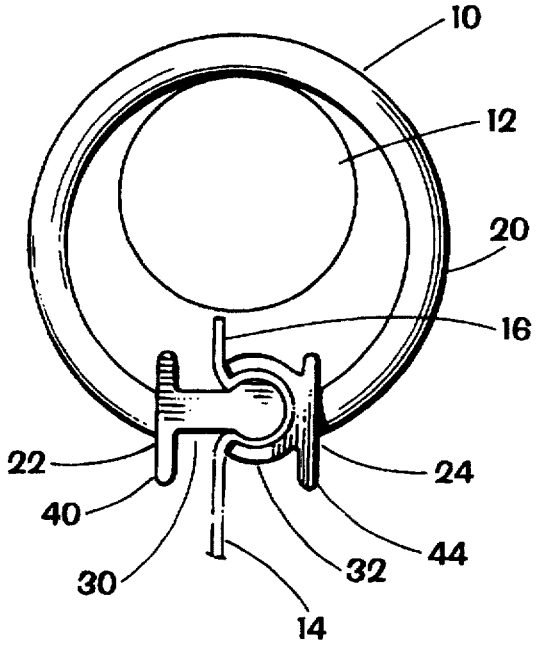
FIG. 6 is a side view of the ring of FIG. 5, with a rod and curtain, shown from the vantage point as in FIG. 2.

FIGS. 5 and 6 show an alternate embodiment of the ring 10 where the first end 22 of the body member connects to the first closure pressure surface 40. This is in contrast to FIGS. 1–4, where the first end 22 connects to the first end locking member 26 on the top of the member 26 instead of the side. Similarly, in FIG. 6, the second end 24 of the body member 20 connects to the second closure pressure surface 44.

Figure 7:
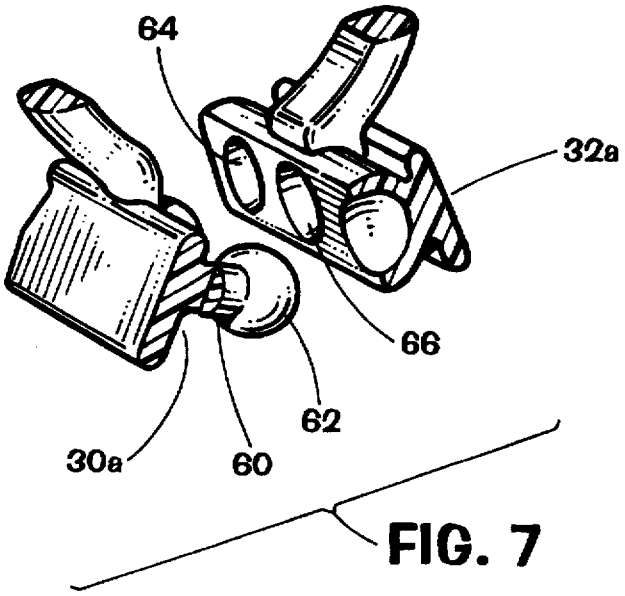
FIG. 7 is a perspective view of the locking means on an alternative ring embodiment in accordance with the present invention.

The horizontal length of the pressure closing surfaces 40 and 44, the pressure opening surfaces 42 and 46, the tip 38, the bar 36, and the channel 48 can of course be varied. Further, the shape of the parts could be varied. For example, as shown in FIG. 7, the male locking protrusion 30a can take the form of a plurality of shafts 60 with enlarged bulbs 62 on the end of each shaft 60. Corresponding to each bulb 62 in this embodiment would be generally spherical receptacles 64 in the female locking receptacle **32*a*, sized internally to be able to receive and hold the bulbs 62, while having somewhat smaller apertures 66**, to provide the same type of releasable interference holding as described above.

The shower curtain ring is preferably constructed of an inexpensive material that is generally rigid but has some flexibility. Plastic is one suitable material. The rod will typically be made of metal or a rigid plastic. The shower curtain will typically be made from a flexible plastic.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A shower curtain assembly comprising:

a substantially horizontal shower curtain rod, a shower curtain having an upper edge:

a plurality of shower curtain rings each ring including:

a body member that encircles the shower curtain rod, the body member having first and second ends:

a first end locking member which is attached to the first end of the body member and includes a male locking protrusion:

where the male locking protrusion comprises a central body portion and a horizontal bar having an enlarged outer tip, the horizontal bar being attached to the central body portion a second end locking member which is attached to the second end of the body member and includes a female locking receptacle, the female locking receptacle being adapted to receive and hold the male locking protrusion:

the upper edge of the shower curtain being held between the male locking protrusion and the female locking receptacle of each shower curtain ring whereby the curtain is deformed and held between the male locking protrusion and the female locking receptacle without any part of the shower curtain ring passing through the shower curtain.

2. The assembly of claim 1, where the enlarged outer tip has a vertical cross-section that is primarily circular.

3. The assembly of claim 1, where the male locking protrusion further comprises a first closure pressure surface that is attached to the horizontal bar.

4. The assembly of claim 3, where the first closure pressure surface is vertical.

5. The assembly of claimed 1, where the male locking protrusion further comprises a first opening pressure surface that is attached to the horizontal bar.

6. The assembly of claim 5, where the first opening pressure surface is vertical.

7. The assembly of claim 1, where the female locking receptacle comprises a horizontal channel which faces toward the male locking protrusion and has a longitudinal aperture, the horizontal channel having a vertical inner diameter that is greater than the vertical size of the longitudinal aperture.

8. The assembly of claim 7, where the horizontal channel has a vertical cross-section that is primarily circular.

9. The assembly of claim 7, where the female locking receptacle further comprises a second closure pressure surface.

10. The assembly of claim 9, where the second closure pressure surface is vertical.

11. The assembly of claim 7, where the female locking receptacle further comprises a second opening pressure surface.

12. The assembly of claim 11, where the second opening pressure surface is vertical.

13. A shower curtain assembly, comprising:

a substantially horizontal shower curtain rod;

a shower curtain having an upper edge;

a plurality of shower curtain rings, each ring including:

a body member that encircles the shower curtain rod, the body member having first and second ends;

a male locking protrusion which is attached to the first end of the body member and comprises: a central body portion; a horizontal bar having an enlarged outer tip, the horizontal bar being attached to the central body portion; a first closure pressure surface; and a first opening pressure surface;

a female locking receptacle which is attached to the second end of the body member and is adapted to receive and hold the male locking protrusion, the female locking receptacle comprising: a horizontal channel which faces toward the male locking protrusion and has a longitudinal aperture, the horizontal channel having a vertical inner diameter that is greater than the vertical size of the longitudinal aperture; a second closure pressure surface; and a second opening pressure surface;

the upper edge of the shower curtain being held between the male locking protrusion and the female locking receptacle of each shower curtain ring, whereby the curtain is deformed and held between the male locking protrusion and the female locking receptacle without any part of the shower curtain ring passing through the shower curtain.

14. A shower curtain ring, comprising:

a body member that is adapted to encircle a shower curtain rod, the body member having first and second ends;

a male locking protrusion which is attached to the first end of the body member and comprises: a central body portion; a horizontal bar having an enlarged outer tip, the horizontal bar being attached to the central body portion; a first closure pressure surface; and a first opening pressure surface;

a female locking receptacle which is attached to the second end of the body member and is adapted to receive and hold the male locking protrusion, the female locking receptacle comprising: a horizontal channel which faces toward the male locking protrusion and has a longitudinal aperture, the horizontal channel having a vertical inner diameter that is greater than the vertical size of the longitudinal aperture; a second closure pressure surface; and a second opening pressure surface;

the male locking protrusion and female locking receptacle being adapted to hold the upper edge of a shower curtain being such that the curtain is deformed and held between the male locking protrusion and the female locking receptacle without any part of the shower curtain ring passing through the shower curtain.

* * * * *